US009816212B2

(12) United States Patent
Morris et al.

(10) Patent No.: US 9,816,212 B2
(45) Date of Patent: Nov. 14, 2017

(54) THREADING APPARATUS

(71) Applicant: Crayola, LLC, Easton, PA (US)

(72) Inventors: Oliver Morris, Evenwood Close (GB); Roseld V. Laguatan, Bath, PA (US); James Allen, Nazareth, PA (US)

(73) Assignee: Fuse London Limited, London (GB)

( * ) Notice: Subject to any disclaimer, the term of this patent is extended or adjusted under 35 U.S.C. 154(b) by 495 days.

(21) Appl. No.: 14/490,314

(22) Filed: Sep. 18, 2014

(65) Prior Publication Data

US 2016/0009521 A1 Jan. 14, 2016

(30) Foreign Application Priority Data

Jul. 14, 2014 (GB) ..... 1412502.5

(51) Int. Cl.

| | |
|---|---|
| ***D04D 1/02*** | (2006.01) |
| ***B65H 54/02*** | (2006.01) |
| ***D02G 3/38*** | (2006.01) |
| ***B65H 54/10*** | (2006.01) |
| ***B65H 81/08*** | (2006.01) |

(52) U.S. Cl.

CPC ..... *D04D 1/02* (2013.01); *B65H 54/02* (2013.01); *B65H 54/106* (2013.01); *B65H 81/08* (2013.01); *D02G 3/38* (2013.01); *B65H 2701/31* (2013.01)

(58) Field of Classification Search

CPC ..... D04D 1/02; D02G 3/38
USPC ..... 57/10–13
See application file for complete search history.

(56) References Cited

U.S. PATENT DOCUMENTS

| | | | | |
|---|---|---|---|---|
| 1,284,625 | A * | 11/1918 | Emrick | D07B 3/06 57/13 |
| 2,353,727 | A * | 7/1944 | Howard | D07B 7/14 242/441.2 |
| 2,366,198 | A | 1/1945 | Kresse et al. | |
| 3,098,373 | A | 7/1963 | Langston | |
| 3,667,203 | A | 6/1972 | Koschatzky et al. | |
| 3,727,390 | A * | 4/1973 | Schwarz | H01B 13/0207 57/13 |
| 3,749,055 | A | 7/1973 | Benson | |
| 3,808,618 | A | 5/1974 | Arimoto et al. | |

(Continued)

FOREIGN PATENT DOCUMENTS

| | | | |
|---|---|---|---|
| DE | 4427687 | A1 | 2/1996 |
| JP | H11106133 | A | 4/1999 |
| JP | 2010261130 | A | 11/2010 |

OTHER PUBLICATIONS http://fatbraintoys.com/toy_companies/alex/fantastic_spinner.cfm (Jan. 18, 2009 via wayback).*

(Continued)

*Primary Examiner* — Shaun R Hurley
(74) *Attorney, Agent, or Firm* — Head, Johnson, Kachigian & Wilkinson, PC

(57) ABSTRACT

There is provided an apparatus for forming at least one threaded member. The apparatus includes a rotatable member, at least one holding member protruding from the rotating member, the at least one holding member having at least one spool and/or the like of a threaded material located thereon. The at least one holding member is offset to the axis of rotation of the rotating member such that upon rotation of said rotating member, the threaded material is wrapped around an article provided with the apparatus.

41 Claims, 9 Drawing Sheets

(56) References Cited

U.S. PATENT DOCUMENTS 3,882,662 A * 5/1975 Hazelwood ..... B65H 81/08 242/442
4,346,550 A * 8/1982 Ferree ..... H01B 13/0808 242/439.5
4,426,834 A * 1/1984 Dokmo ..... B65H 81/08 242/441.3
4,502,409 A 3/1985 Perry et al.
5,263,309 A * 11/1993 Campbell ..... D07B 3/06 57/13
5,452,517 A 9/1995 Lothmann
5,588,290 A * 12/1996 Cobb ..... B65H 81/08 242/441.2
5,979,288 A * 11/1999 Gallagher ..... D04C 1/06 57/10
5,983,617 A * 11/1999 Nelson ..... G02B 6/449 242/439.5
6,519,924 B1 * 2/2003 Barz ..... A01G 5/02 57/10
6,662,808 B2 * 12/2003 Leason ..... A45D 2/00 132/212
7,001,465 B1 2/2006 Thomas
7,520,120 B2 * 4/2009 Saito ..... H01B 13/0866 57/10
8,079,205 B2 * 12/2011 Nava ..... B65H 81/08 57/13
8,567,170 B2 * 10/2013 Andros ..... A01C 1/042 57/10
2003/0224118 A1 12/2003 Huang et al.
2004/0074220 A1 4/2004 Harmon
2006/0107644 A1 * 5/2006 Dye ..... A61N 1/05 57/13
2012/0241546 A1 9/2012 Shimp et al.
2012/0244353 A1 9/2012 Wright

OTHER PUBLICATIONS

Notice of Allowance dated Aug. 4, 2016 in U.S. Appl. No. 14/701,174, 18 pages.
European Search Report dated May 31, 2016 in European Patent Application No. 15275172.3, 9 pages.
Non-Final Office Action dated Apr. 29, 2016 in U.S. Appl. No. 14/701,174, 10 pages.
European Search Report dated Dec. 7, 2015 in Application No. 15275171.5, 9 pages.

* cited by examiner

THREADING APPARATUS

CROSS-REFERENCE TO RELATED APPLICATIONS

This application claims priority to United Kingdom Patent Application No. 1412502.5 filed Jul. 14, 2014 which is incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention to which this application relates is a threading apparatus.

2. Prior Art

Although the following description refers to a children's toy in the form of a thread-wrapping machine, the person skilled in the art will appreciate that the present invention could also be used for other threading and/or winding purposes.

Children's toys enabling the user to thread and/or lace a plurality of articles together to form bracelets/anklets/necklaces and/or the like have been known for some time. They can be provided in various forms, for example, some are provided with a single piece of thread, lace etc. on which charms and other decorative articles are threaded, creating a custom necklace, bracelet or anklet. Alternatively, a user may wish to create a customized bracelet, often termed a "friendship bracelet". This may involve intertwining a number of different threads about each other in order to create a more intricate design. Charms and other decorative articles may be added again in order to further customize the bracelet. Often, the children constructing jewellery items such as these will do so with their hands, and the process can be quite time consuming.

It is therefore an aim of the present invention to provide an apparatus for creating various threaded articles that overcomes the aforementioned problems.

It is a further aim of the present invention to provide a method of thread-wrapping to create a threaded article overcoming the problems associated with the prior art.

BRIEF SUMMARY OF THE INVENTION

According to a first aspect of the invention there is provided an apparatus for forming at least one threaded member, said apparatus including: a rotatable member; at least one holding member protruding from said rotating member; said at least one holding member having at least one spool and/or the like of a threaded material located thereon, wherein said at least one holding member is offset to the axis of rotation of the rotating member such that upon rotation of said rotating member, the said threaded material is wrapped around an article provided with the apparatus.

Typically the article is substantially mounted along the axis of rotation of the rotatable member.

In one embodiment the rotatable member is mounted for rotation in a housing and the housing includes means to allow the powered or manual movement of the rotatable member.

In one embodiment the rotatable member has two or more holding members which are spaced apart. In one embodiment each of the holding members is offset from the axis of rotation and each is capable of receiving a spool or the like thereon.

In one embodiment, said apparatus is provided with a base portion. Typically, a support portion is provided on said base portion. Further typically, said article may be located on said support portion.

In one embodiment, said housing is movable on said base portion. Typically, said housing is movable relative to a support portion located on said base portion. Further typically, said support portion is fixed relative to said base portion.

In one embodiment, said housing is provided integral with said base portion and movable thereon with respect to the support portion.

In one embodiment, said housing is detachably attached to a base portion.

In one embodiment, said rotating member is provided with an aperture located therein. Typically, said aperture is located in a substantially central position on said rotating member. Further typically, said aperture is sized to receive said article.

In one embodiment, said article, located on said support portion, is received through said aperture upon movement of said housing along said base portion and towards said support portion.

In one embodiment, rotation of said rotating member is actuated by activation means. Typically, said activation means are in the form of switch means.

In one embodiment, rotation of said rotating member rotates said holding members about said article.

In one embodiment, three or more holding members are provided on said rotating member.

In one embodiment, said article is provided as a tubular member, having first and second ends. Typically, a first end of said article is detachably attached to a support portion.

In one embodiment, said two or more holding members, each having at least one spool and/or the like of a threaded material located thereon are located radially outward of a centrally located aperture on said rotating member. Typically, a first end of said threaded material is attached to a first end of said article. Further typically, a first end of threaded material of each spool and/or the like of threaded material on each holding member is attached to a first end of said article.

In one embodiment, said rotating member rotates said two or more holding members and, hence said spools and/or the like of threaded material about said article, causing two or more strands of threaded material to simultaneously wrap about said article.

In one embodiment, rotation of said rotating member continues until said article is wrapped in threaded material to an extent selected by the user.

In one embodiment, cover means are provided on said apparatus. Typically, said cover means acts as a protective guard against rotating components of the apparatus. Further typically, said cover means includes an aperture located substantially opposite an aperture on said rotating member. Yet further typically, said article is sized to be received through each of said apertures.

In one embodiment, wrapping of said threaded material about said article occurs within said cover means.

In one embodiment, said cover means is provided as a substantially transparent casing.

In one embodiment, two or more guide means are provided on said rotating member, associated with said two or more holding members. Typically, said guide means are provided with an aperture located therein. Further typically, said threaded material associated with each of said two or more holding members is received through the aperture located on the associated guide means.

In one embodiment, said article is located on a support portion. Typically, said support portion is separate from said apparatus.

In one embodiment, said support portion includes a first face and a second, opposing face.

In one embodiment, there is located a plate member on said first face of said support portion. Typically said plate member is rotatable with respect to the support portion. Further typically, said plate member is detachably attachable to said two or more holding members. Yet further typically, rotation of said plate member is actuated by rotation of said rotating member.

In one embodiment, said plate member includes an aperture located thereon. Typically, said aperture is located centrally of said plate member. Further typically, said aperture is sized to receive threaded material.

In one embodiment, said support portion includes an aperture located thereon. Typically, said aperture is located substantially in line with the aperture located on said plate member. Further typically, said aperture is sized to receive threaded material.

In one embodiment, said article is located on said second face of said support portion. Typically, said article is detachably attached to said second face.

In one embodiment, said article is rotatable with respect to said support portion. Typically, rotation of said article is actuated by rotation of said rotating member. Further typically, said article rotates at a slower angular velocity than that of said rotating member.

In one embodiment, guide means are located on said second face of said support portion. Typically, said guide means are provided with an aperture located therein.

In one embodiment, a first end of two or more spools of threaded material, located on said two or more holding members, are fed, in series, through associated guide means, through apertures located on said plate member and said support portion, through guide means located on said second face of said support portion, and attached to a first end of said article.

In one embodiment, rotation of said rotating member causes the threaded material of the two or more spools to intertwine. Typically, said threaded material is subsequently wrapped about said article. Further typically, said threaded material, wrapped about said article, comprises two or more individual strands of threaded material, creating a composite thread. Yet further typically, said composite thread is removable from said article.

In one embodiment, means for changing the colour of the thread may be included with said apparatus. Typically, said means is provided to alter the pigment of one or more strands of said threaded material. Further typically, said means is provided to dye said one or more strands of threaded material prior to wrapping said thread material about said article.

In a further aspect of the present invention, there is provided an apparatus for forming at least one threaded member about an article, said apparatus including: a rotating member; two or more holding members protruding from said rotating member; said two or more holding members each having at least one spool and/or the like of a threaded material located thereon, wherein upon rotation of said rotating member, two or more strands of threaded material associated with the two or more holding members simultaneously wrap around said article.

In one embodiment, said article, having said two or more strands of threaded material wrapped therearound, forms at least a part of an item of jewellery, children's jewellery and/or the like.

In yet a further aspect of the present invention there is provided an apparatus for forming at least one threaded member, said apparatus including: a rotating member; two or more holding members protruding from said rotating member; said two or more holding members each having at least one spool and/or the like of a threaded material located thereon, wherein upon rotation of said rotating member, two or more strands of threaded material associated with the two or more holding members simultaneously wrap about each other and subsequently around said article.

In one embodiment, said threaded member is a composite of two or more strands of threaded material. Typically, said threaded member can be removed from said article to form an item of jewellery, children's jewellery and/or the like.

In one embodiment, two or more guide means are provided on said rotating member, associated with said two or more holding members. Typically, said guide means are provided with an aperture located therein. Further typically, said threaded material associated with each of said two or more holding members is received through the aperture located on the associated guide means.

In yet a further aspect of the present invention there is provided a method of forming at least one threaded member about an article, said method including the steps of: providing an apparatus including a rotating member, providing at least one holding member protruding from said rotating member; providing on said at least one holding member at least one spool and/or the like of a threaded material located thereon; connecting the end of the threaded material to a first end of said article; rotating said rotating member such that said threaded material wraps around said article.

In yet a further aspect of the present invention there is provided a method of forming at least one threaded member, said method including the steps of: providing an apparatus including a rotating member; two or more holding members protruding from said rotating member, said two or more holding members each having at least one spool and/or the like of a threaded material located thereon, guide means associated with each of said two or more holding members; feeding ends of two or more strands of threaded material associated with the two or more holding members through apertures located on said guide means and connecting the same to a first end of an article, said article located on a support portion attachable to said apparatus; attaching said support portion to said apparatus, and wherein upon rotation of said rotating member, said strands of threaded material associated with the two or more holding members simultaneously wrap about each other and subsequently around said article, forming a threaded member that is a composite of two or more strands of threaded material.

BRIEF DESCRIPTION OF THE DRAWINGS

Embodiments of the present invention will now be described with reference to the accompanying figures, wherein.

DETAILED DESCRIPTION OF THE INVENTION

Figure 1:
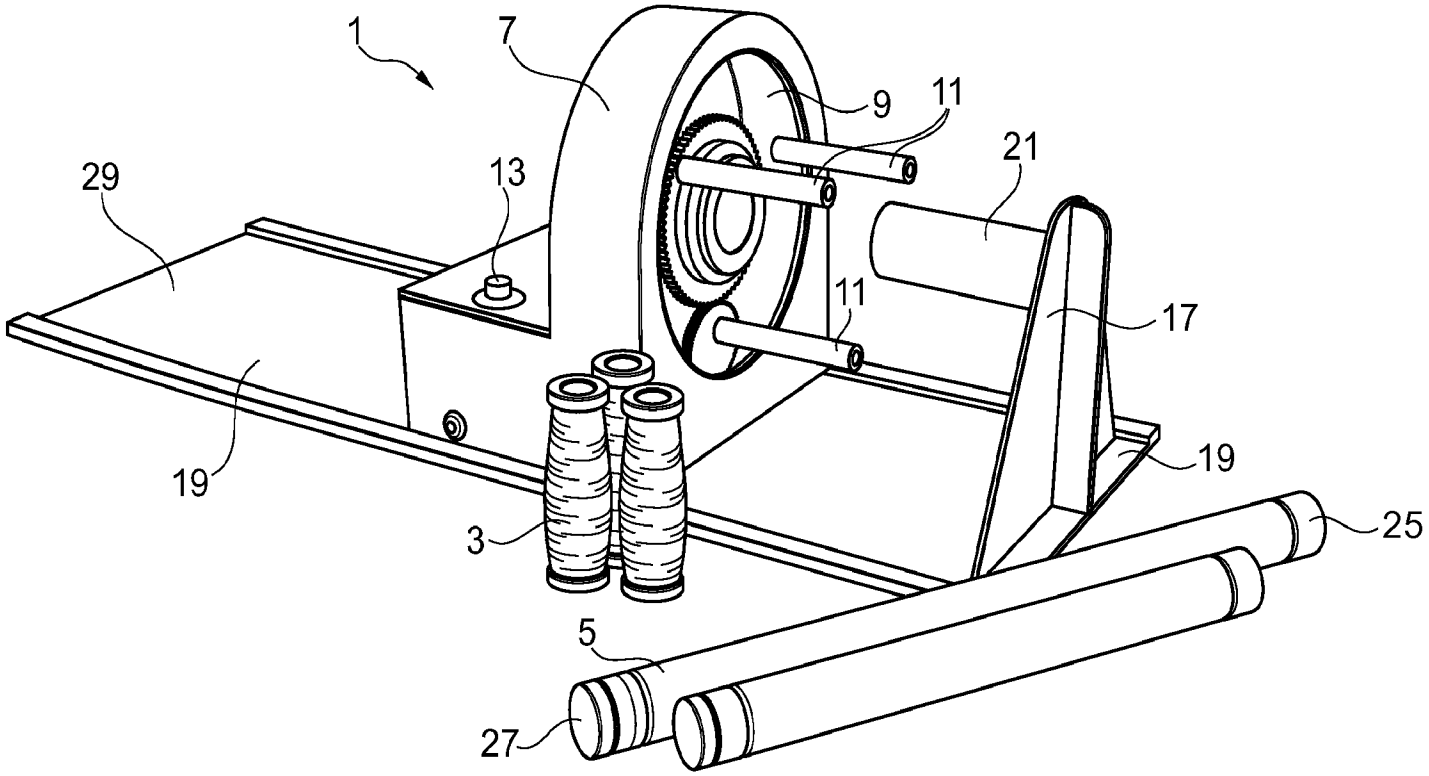
FIG. 1 illustrates an apparatus in accordance with an embodiment of the present invention.
Figure 2:
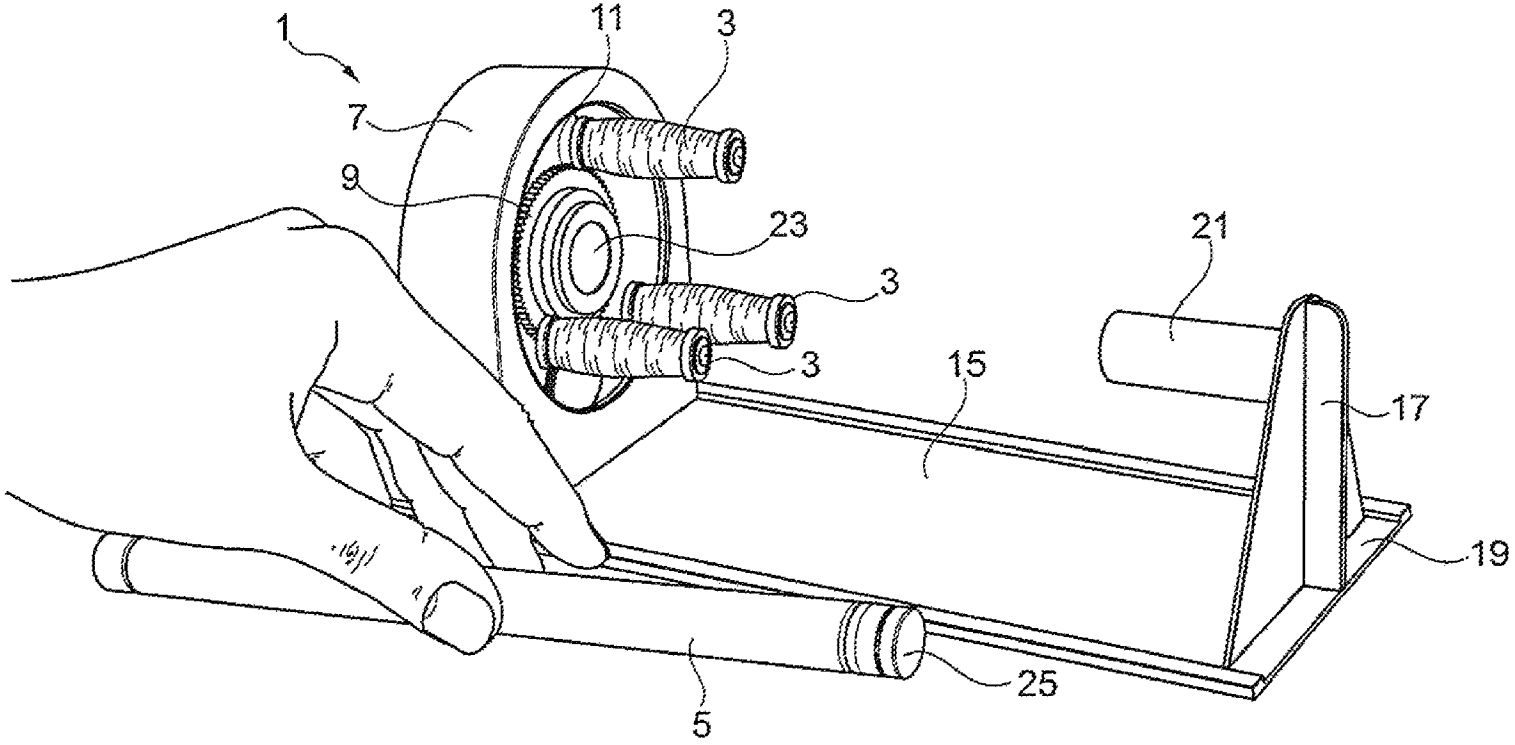
FIG. 2 illustrates an apparatus with spools of threaded material affixed thereto, in accordance with another embodiment of the present invention.
Figure 3:
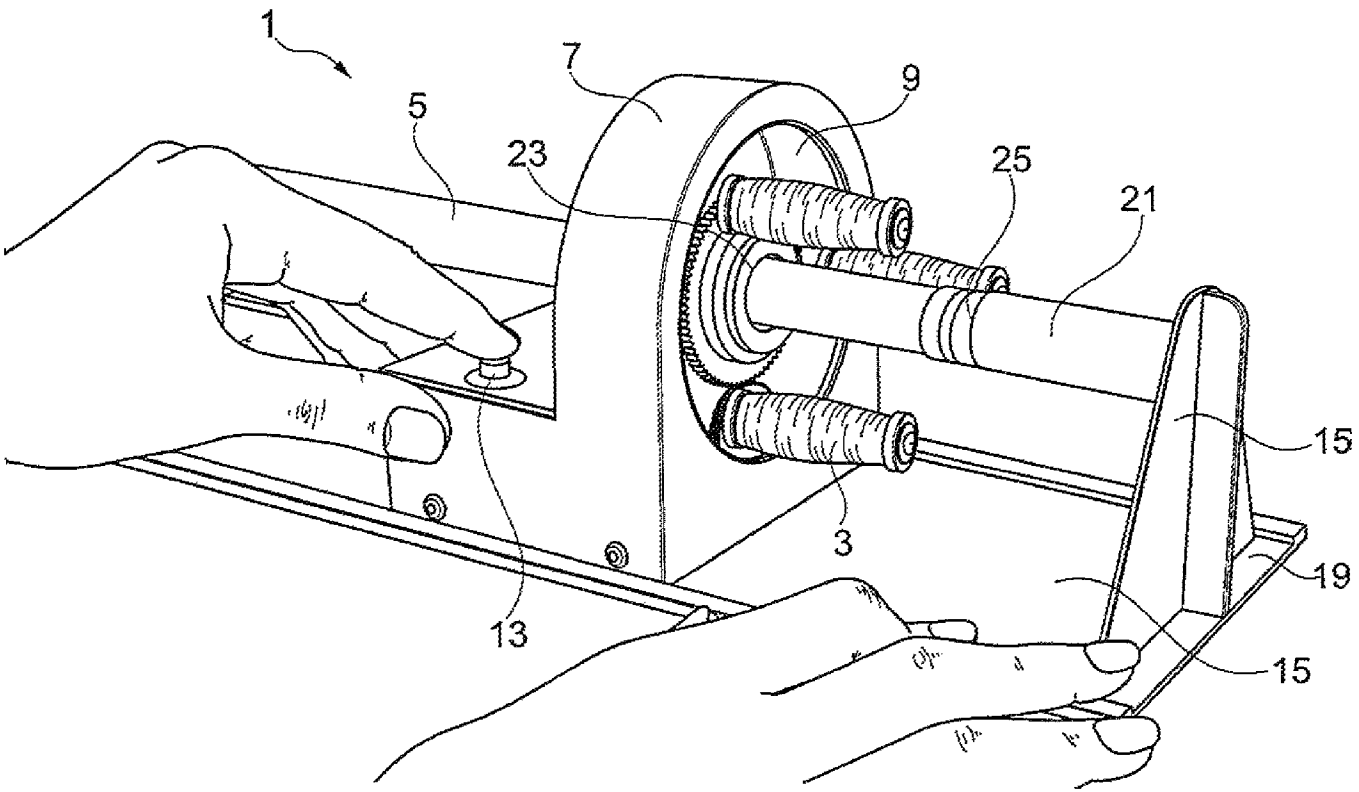
FIG. 3 illustrates an apparatus with spools of threaded material and an article affixed thereto, in accordance with another embodiment of the present invention.

Referring firstly to FIGS. 1-3, there is provided an apparatus in the form of a thread-wrapping machine (1) provided to enable thread from a number of spools (3) to be simultaneously wrapped about an article (5). The thread-wrapping machine (1) includes a housing (7) in which there is located a rotating member in the form of a disc (9). In this embodiment the disc (9) has a number of holding members in the form of spool holding bars (11) protruding outwardly therefrom, on which the spools (3) may be placed. Although the present example illustrates three holding bars (11) on the disc (9), the skilled person will appreciate that this number may vary depending on the specifications of the thread wrapping machine. Rotation of the disc (9) is activated by switch (13) located on the housing (7) of the apparatus (1). The housing (7) of the apparatus (1) is located on a base (15) and is movable therealong relative to a supporting portion (17), located at an end (19) of the base (15), which is fixed in position on the base (15). A support bar (21) is provided on the supporting portion (17), protruding outwardly therefrom toward the housing (7). A central hole (23) is formed in the rotating disc (9) and extends through the housing (7) of the apparatus (1). The hole (23) is located substantially in line with the support bar (21).

A first end (25) of the article (5) about which thread is to be wrapped is attached to the support bar (21). The article (5) has a maximum radius sized to fit through the hole (23) in the housing (7) and once located on the support bar (21), a second end (27) of the article (5) extends through the hole (23), allowing the housing (7) to move back and forth along the base (15) with the article (5) sliding through the hole (23). With the spools (3) located on their respective holding bars (11), the ends of each strand of thread are taken and attached to the first end (25) of the article (5), with the housing (7) located in close proximity to the supporting portion (17) initially. Once the thread ends are attached to the article (5), the switch (13) is activated, causing the disc (9), and consequently the holding bars (11) and spools (3), to rotate about the article (5). During rotation, thread is unwound from the spools (3) forming a layer of multiple strands of thread simultaneously wrapped about the article (5). As the article (5) is wrapped with thread, the housing (7) is moved gradually away from the supporting portion (17) along the base, thereby exposing more of the article (5) to be wrapped. The spools (3) of thread may be provided in various colours, resulting in a varying range of colours and/or patterns of thread wrapped about the article (5). Once the article (5) has been wrapped/covered in thread to a sufficient degree or to a user's satisfaction, rotation of the disc (9) is ceased via the switch (13), the housing (7) moved to a distal end (29) of the base away from the supporting portion (17), thereby allowing the article (5), now wrapped in multiple strands of thread, to be removed from the support bar (21).

The article (5) may subsequently be used as an item of novelty/children's jewellery, or as an accessory/attachment to an item of children's jewellery.

While the housing (7) of the thread-wrapping machine (1) is movable along the base portion (15) with respect to the supporting portion (17), it may also be detachably attached thereto, allowing a user to remove the housing (7) for maintenance, repair, or even use without the need for the base or supporting portions (15, 17).

Figure 4:
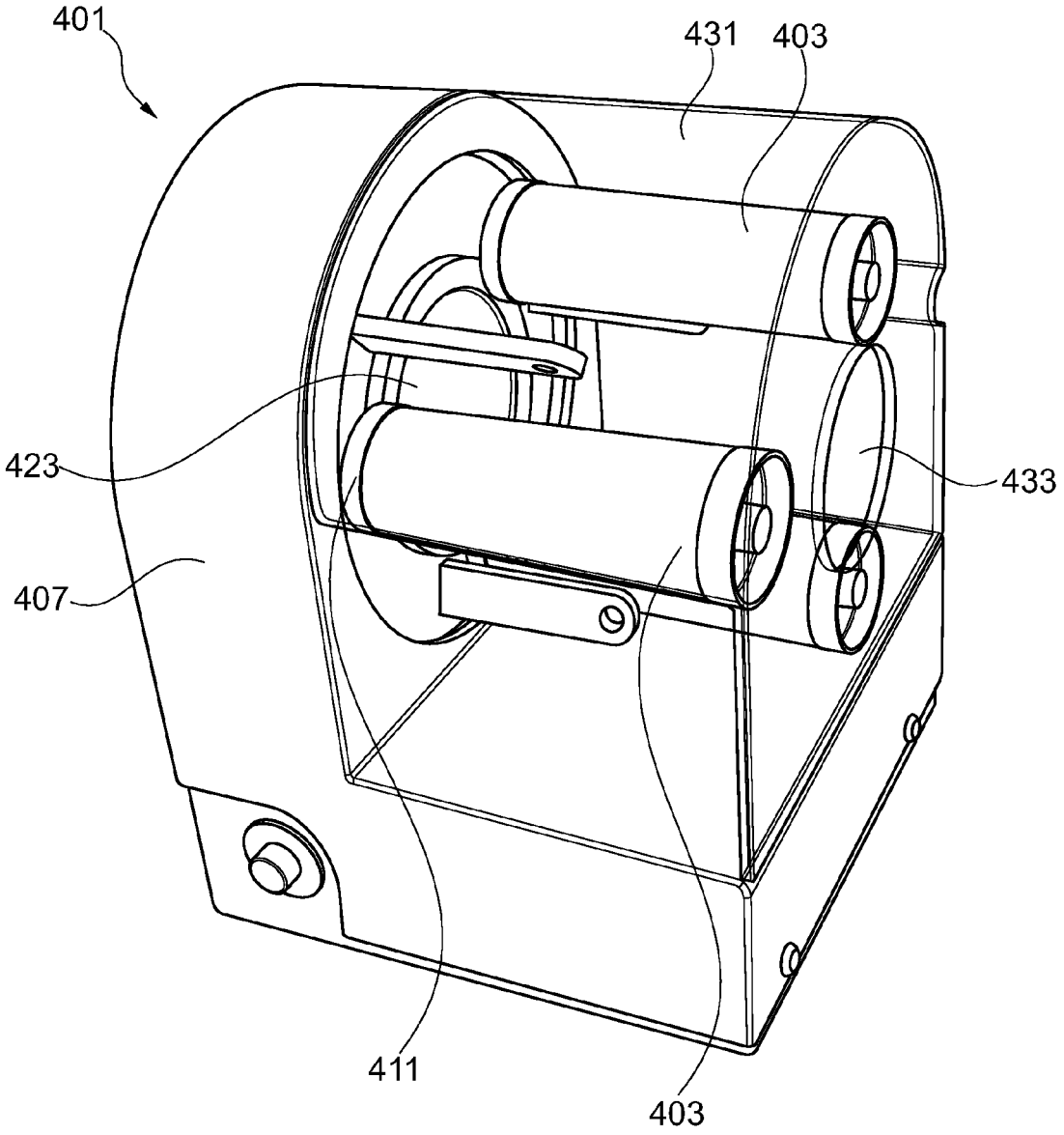
FIG. 4 illustrates an apparatus having a cover means in accordance with an embodiment of the present invention.
Figure 5:
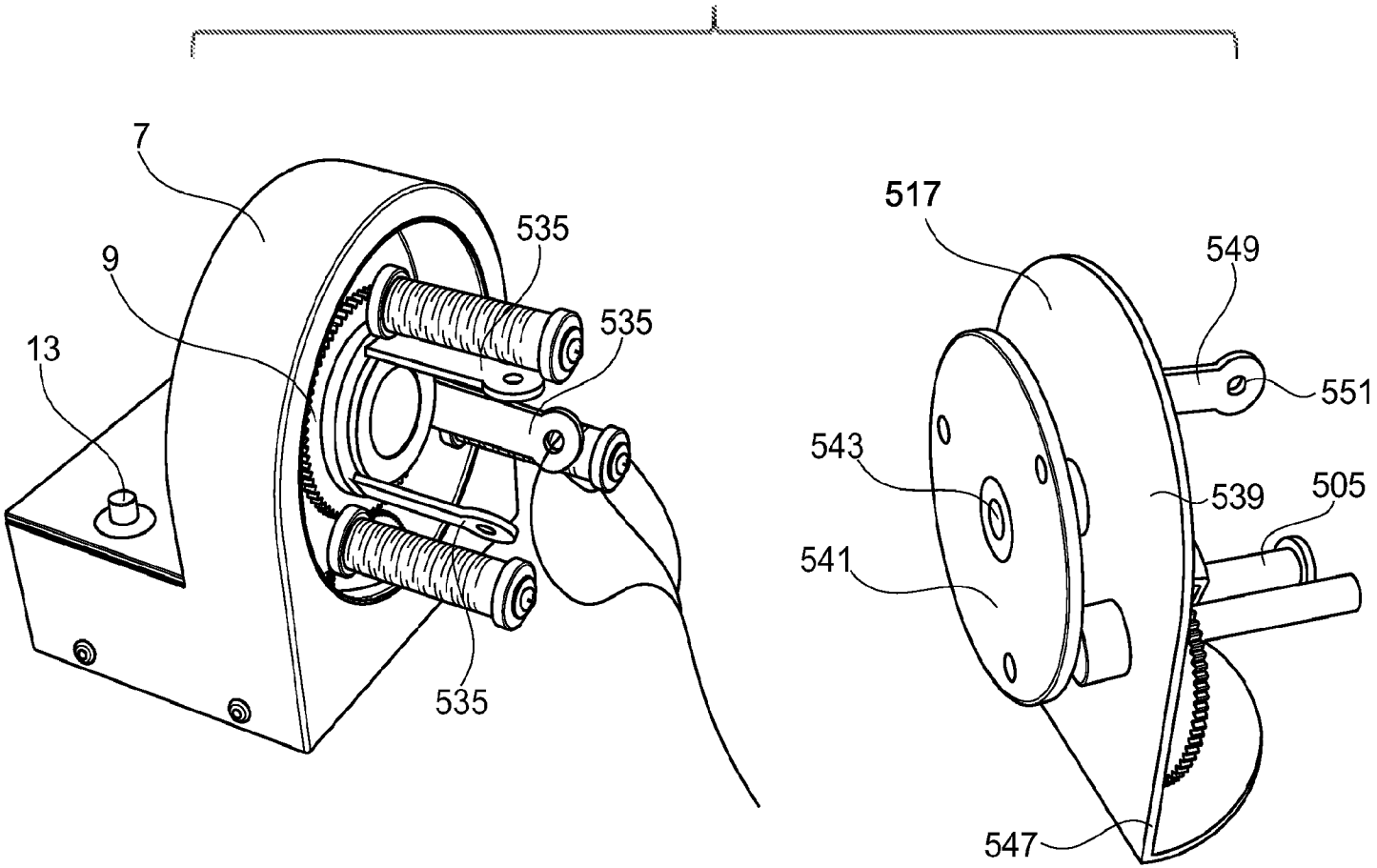
FIG. 5 illustrates an apparatus and support portion in accordance with an embodiment of the present invention.
Figure 6:
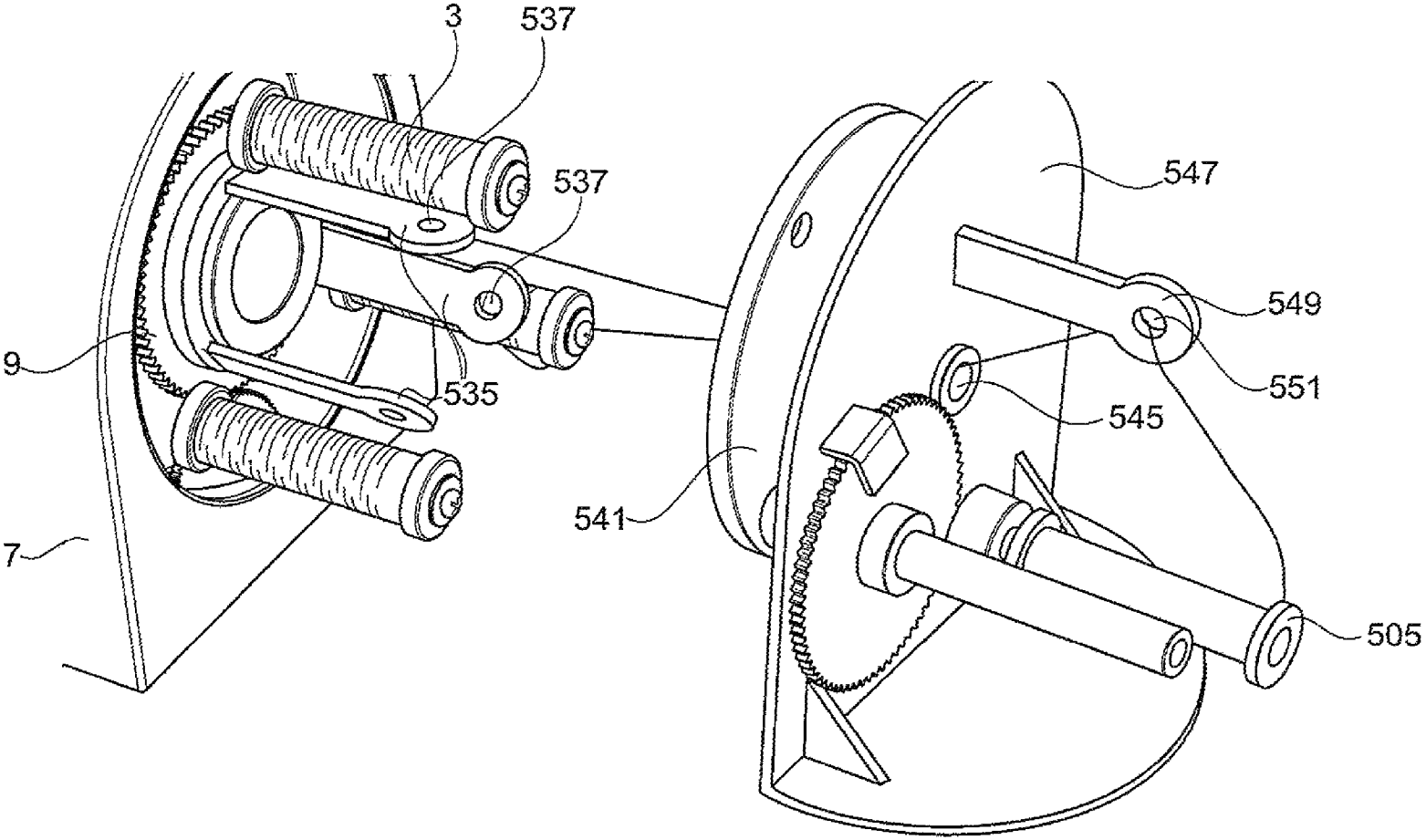
FIG. 6 illustrates an apparatus and support portion with threaded material fed therethrough, in accordance with an embodiment of the present invention.
Figure 7:
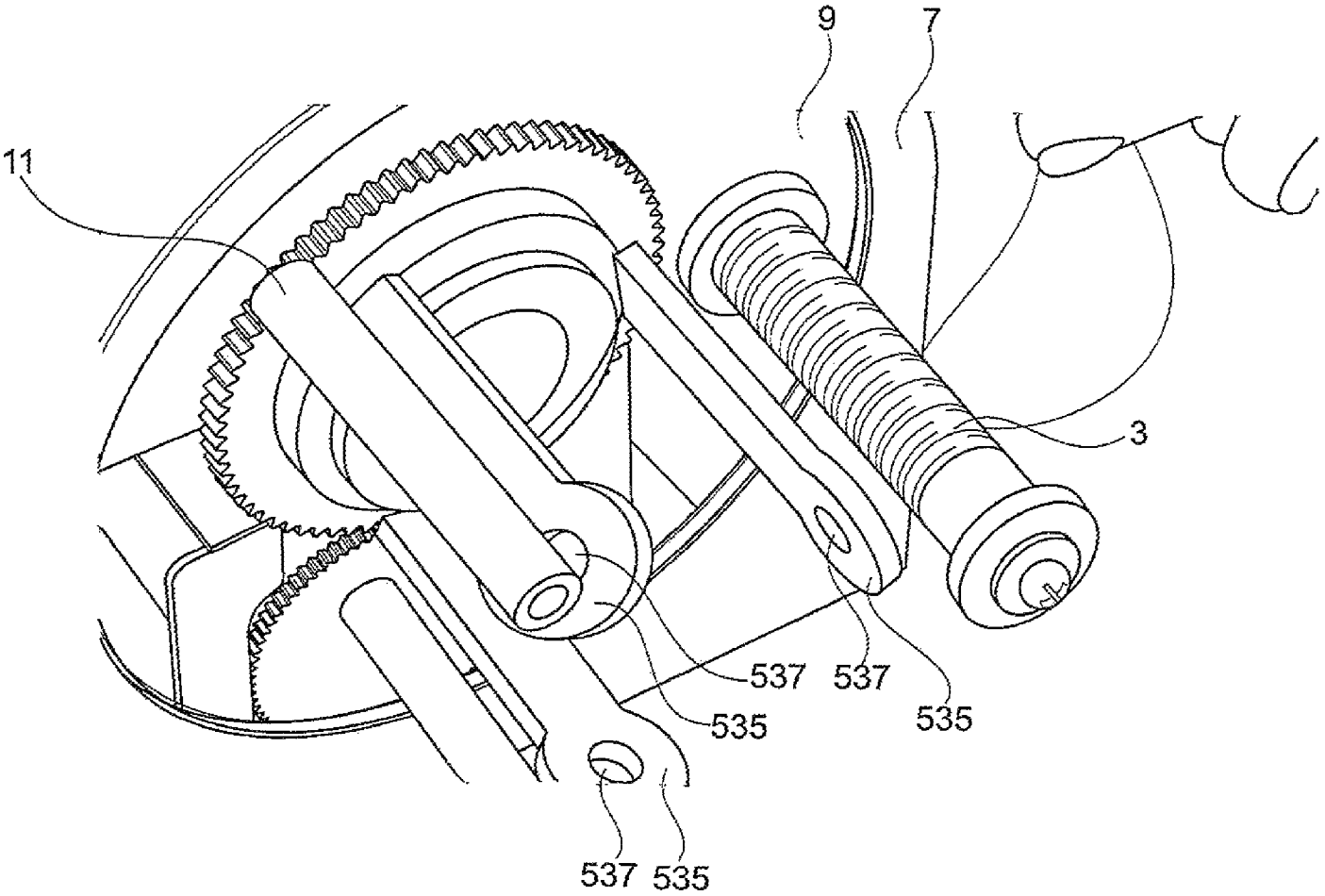
FIG. 7 illustrates a close-up view of an apparatus in accordance with an embodiment of the present invention.
Figure 8:
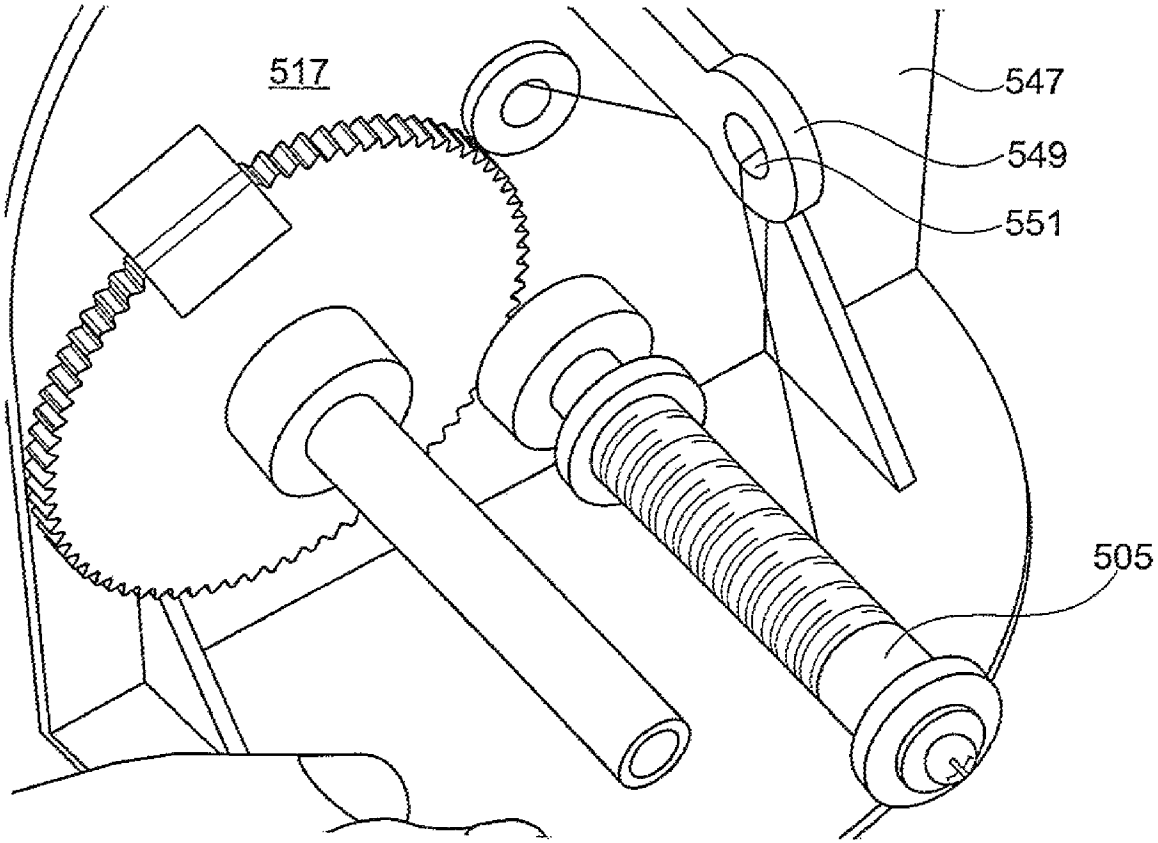
FIG. 8 illustrates a close-up view of a support portion of an apparatus in accordance with an embodiment of the present invention.
Figure 9:
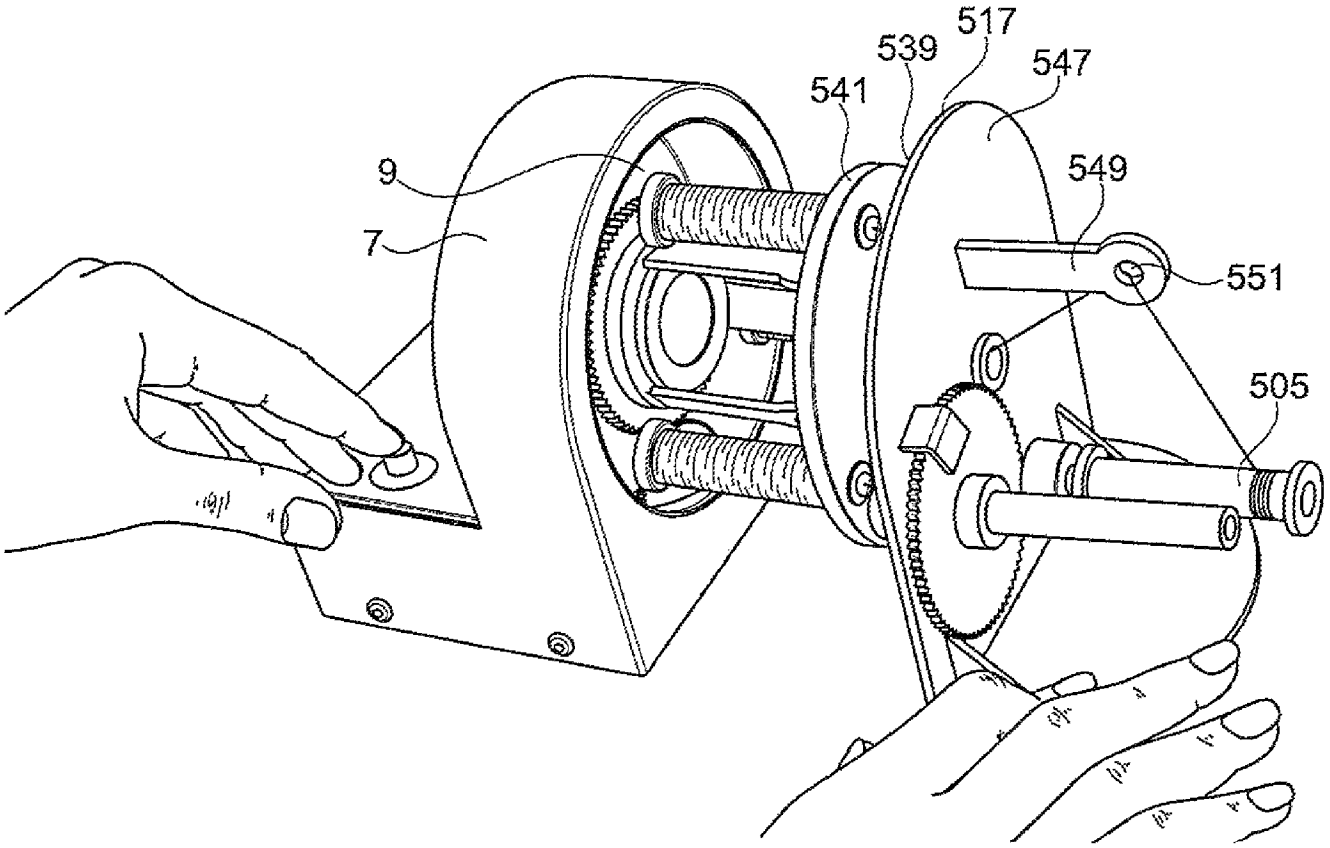
FIG. 9 illustrates an apparatus and support portion connected and in use, in accordance with an embodiment of the present invention.

FIG. 4 illustrates an alternative embodiment of the thread-wrapping machine (401), which includes a protective cover (431) located thereon. The cover (431) encases the holding bars (411) and, hence, the spools (403) thereby preventing any fast-moving parts from becoming detached from the apparatus while moving and causing injury to a user. In order for an article to be wrapped when the apparatus (401) is presented in this form, the cover (431) includes a hole (433) located in its face opposite the central hole (423) of the housing (407). In this embodiment, a user holds the article (not shown) as it passes through the holes (433, 423) and is wrapped in thread. The cover (431) is also provided as a transparent body, enabling the user to view the progress of the thread-wrapping action.

Referring now to FIGS. 5-9, there is provided the housing (7) of the thread-wrapping machine (1) depicted in FIGS. 1-3. However, in this particular embodiment, the main body has been detached from the base portion (15). Guide means (535) are affixed to the rotating disc (9), each of which is associated with a corresponding holding bar (11), and located radially between each holding bar (11) and the central hole (23). Each guide means (535) has a guide hole (537) through which thread from each pool (3) is fed. Such a feature allows the individual thread strands to be combined and, upon rotation of the disc (9), intertwined, thereby creating a composite thread made from two, three or potentially more individual strands of thread.

An alternative supporting portion (517) is provided, which includes two faces. On the first face (539) there is located a plate (541), which is rotatable with respect to the supporting portion (517). The plate (541) can be attached to the holding bars (11) of the housing (7) or spools (3) located thereon. Such an attachment provides a connection between the supporting portion (517) and the housing (7) of the apparatus (1), such that upon rotation of the disc (9), the plate (541) is caused to rotate at the same angular velocity. The plate (541) includes a hole (543) located centrally thereon and in line with the hole (23) of the rotating disc (9) and a further hole (545) located on the supporting portion (517) extending through its first face to a second, opposing face (547). The holes (543, 545) are sized to allow strands of thread to pass therethrough. An alternative article (505) is located on the second face (547) of the supporting portion (517). The article (505) may be detachably attached to the supporting portion and, while attached, is rotatable with respect to the sporting portion (517). Rotation of the article (505) is actuated by rotation of the disc (9) and, consequently, the plate (541). However, the article (505) is arranged to rotate at a slower angular velocity than that of the disc (9) and the plate (541). Additional guide means (549) is provided on the second face (547) of the supporting portion (517) having a guide hole (551) located therein. The guide means (549) allows thread, which has been fed through guide holes (537) and subsequently holes (543, 545) in the plate (541) and supporting portion (517), to be fed through its guide hole (551) and finally attached to a first end (525) of the article (505). As the switch (13) is activated and the disc (9) rotates, the strands of thread from each spool (3) begin to intertwine with one another and are slowly fed onto and wrap around the article (505), creating a composite thread formed from multiple individual strands of thread. In theory, if several lengths of composite thread are formed, these can be put through the same process as the spools (3) of individual thread, thereby creating a secondary composite thread, and so on. Once wrapping of the thread about the article (505) is complete, the composite thread may be removed and used as an item of children's jewellery, such as a necklace, bracelet, friendship bracelet, anklet and/or the like.

Additionally, dying apparatus such as a marker (not shown) may be affixed to the apparatus and arranged so as to colour and/or recolour one or more of the strands of thread as they unwind from their respective spools. This feature may be added to alter the colour of a particular thread prior to it being intertwined with other thread strands and/or being wrapped about the article. For example, a user may affix a spool of white thread and wish to colour it prior to wrapping. This can be achieved by the provision of an appropriately coloured marker located in position on the apparatus. Several locations for markers may be provided so a user can, if they choose, colour each spool of thread that is place on the holding bars of the thread-wrapping machine.

The invention claimed is:

1. Apparatus for forming at least one threaded member, said apparatus including:

a rotatable member; and at least one holding member protruding from said rotatable member;

said at least one holding member having at least one spool of a threaded material located thereon, wherein said at least one holding member is offset to the axis of rotation of the rotatable member such that upon rotation of said rotatable member, the said threaded material is wrapped around said article;

wherein means for changing a colour of the thread are included with said apparatus; and wherein said means is provided to alter a pigment of one or more strands of threaded material associated with said apparatus by dying said one or more strands of threaded material prior to wrapping said thread material about said article.

2. Apparatus according to claim 1, wherein the article is substantially mounted along the axis of rotation of the rotatable member.

3. Apparatus according to claim 1, wherein the rotatable member is mounted for rotation in a housing and the housing includes means to allow the powered or manual movement of the rotatable member.

4. Apparatus according to claim 1, wherein the rotatable member has two or more holding members which are spaced apart.

5. Apparatus according to claim 4, wherein each of the holding members is offset from the axis of rotation and each is capable of receiving a spool thereon.

6. Apparatus according to claim 1, wherein said apparatus is provided with a base portion.

7. Apparatus according to claim 6, wherein said housing is movable on said base portion.

8. Apparatus according to claim 7, wherein said housing is movable relative to a support portion located on said base portion.

9. Apparatus according to claim 1, wherein said rotatable member is provided with an aperture located therein.

10. Apparatus according to claim 9, wherein said aperture is located in a substantially central position on said rotatable member and is sized to receive said article.

11. Apparatus according to claim 10, wherein said article is located on a support portion and is received through said aperture upon movement of said housing along a base portion and towards said support portion.

12. Apparatus according to claim 1, wherein rotation of said rotatable member is actuated by activation means.

13. Apparatus according to claim 1, wherein rotation of said rotatable member rotates said holding member about said article.

14. Apparatus according to claim 1, wherein three or more holding members are provided on said rotatable member.

15. Apparatus according to claim 1, wherein said article is provided as a tubular member, having first and second ends, the first end of said article being detachably attached to a support portion.

16. Apparatus according to claim 1, wherein two or more holding members, each having at least one spool of a threaded material located thereon are located radially outward of a centrally located aperture on said rotatable member, and wherein a first end of said threaded material is attached to a first end of said article.

17. Apparatus according to claim 16, wherein said rotatable member rotates said two or more holding members and, hence said spools of threaded material about said article, causing two or more strands of threaded material to simultaneously wrap about said article.

18. Apparatus according to claim 1, wherein cover means are provided on said apparatus, said cover means being provided to act as a protective guard against rotating components of the apparatus.

19. Apparatus according to claim 18, wherein said cover means includes an aperture located substantially opposite an aperture on said rotatable member, said article sized to be received through each of said apertures.

20. Apparatus according to claim 18, wherein wrapping of said threaded material about said article occurs within said cover means.

21. Apparatus according to claim 18, wherein said cover means is provided as a substantially transparent casing.

22. Apparatus according to claim 1, wherein guide means are provided on said rotatable member, associated with said at least one holding member, said guide means being provided with an aperture located therein.

23. Apparatus according to claim 22, wherein said threaded material associated with said at least one holding member is received through the aperture located on the associated guide means.

24. Apparatus according to claim 1, wherein said article is located on a support portion, said support portion being separate from said apparatus.

25. Apparatus according to claim 24, wherein said support portion includes a first face and a second, opposing face.

26. Apparatus according to claim 25, wherein a plate member is located on said first face of said support portion, said plate member being rotatable with respect to the support portion.

27. Apparatus according to claim 26, wherein said plate member is detachably attachable to two or more holding members on said rotatable member.

28. Apparatus according to claim 27, wherein rotation of said plate member is actuated by rotation of said rotatable member.

29. Apparatus according to claim 26, wherein said plate member includes an aperture located thereon, said aperture being located centrally of said plate member and sized to receive threaded material.

30. Apparatus according to claim 29, wherein said support portion includes an aperture located thereon substantially in line with the aperture located on said plate member and to receive threaded material.

31. Apparatus according to claim 25, wherein said article is detachably attached to said second face of said support portion.

32. Apparatus according to claim 31, wherein said article is rotatable with respect to said support portion.

33. Apparatus according to claim 32, wherein rotation of said article is actuated by rotation of said rotatable member.

34. Apparatus according to claim 33, wherein said article rotates at a slower angular velocity than that of said rotatable member.

35. Apparatus according to claim 25, wherein guide means are located on said second face of said support portion.

36. Apparatus for forming at least one threaded member about an article, said apparatus including:

a rotating member;

two or more holding members protruding from said rotating member;

a respective guide member associated with each holding member, each guide member individually protruding from said rotating member, and each guide member provided with an aperture located therein;

said two or more holding members each having at least one spool of a threaded material located thereon, wherein said threaded material is received through the aperture located in the respective guide member, and wherein upon rotation of said rotating member, two or more strands of threaded material associated with the two or more holding members simultaneously wrap around said article.

37. Apparatus according to claim 36, wherein said article, having said two or more strands of threaded material wrapped therearound, forms at least a part of an item of jewelry or children's jewelry.

38. Apparatus for forming at least one threaded member, said apparatus including:

a rotating member, wherein said rotating member is provided with an aperture located therein, and wherein said aperture is located in a substantially central position on said rotating member and is sized to receive an article located on a support portion and received through said aperture upon movement of said housing along a base portion and towards said support portion;

two or more holding members protruding from said rotating member;

said two or more holding members each having at least one spool of a threaded material located thereon, wherein upon rotation of said rotating member, two or more strands of threaded material associated with the two or more holding members simultaneously wrap about each other and subsequently around said article.

39. Apparatus according to claim 38, wherein said threaded member is a composite of two or more strands of threaded material, said threaded member being removable from said article to form an item of jewelry or children's jewelry.

40. Method of forming at least one threaded member about an article, said method including the steps of:

providing an apparatus including a rotating member, providing a plurality of holding members protruding from said rotating member;

providing a respective guide member for each holding member, each guide member individually protruding from said rotating member, and each guide member provided with an aperture located therein; and providing on said at least one holding member at least one spool of a threaded material located thereon, wherein said threaded material is received through the aperture located in the respective guide member;

wherein upon connection of the end of the threaded material to a first end of said article, rotation of said rotating member wraps said threaded material around said article.

41. Method of forming at least one threaded member, said method including the steps of:

providing an apparatus including a rotating member, two or more holding members protruding from said rotating member, said two or more holding members each having at least one spool of a threaded material located thereon, guide means associated with each of said two or more holding members;

receiving ends of two or more strands of threaded material associated with the two or more holding members through apertures located on said guide means, said article located on a support portion attachable to said apparatus; and attaching said support portion to said apparatus;

wherein upon connection of the ends of two or more strands of threaded material to a first end of an article, rotation of said rotating member causes said strands of threaded material associated with the two or more holding members to simultaneously wrap about each other and subsequently around said article, forming a threaded member that is a composite of two or more strands of threaded material.

* * * * *